United States Patent [19]

Garey

[11] Patent Number: 4,905,791

[45] Date of Patent: Mar. 6, 1990

[54] LIGHT WEIGHT HYBRID EXHAUST MUFFLER AND METHOD OF MANUFACTURE

[75] Inventor: David Garey, Toledo, Ohio

[73] Assignee: AP Parts Manufacturing Company, Toledo, Ohio

[21] Appl. No.: 372,255

[22] Filed: Jun. 27, 1989

Related U.S. Application Data

[63] Continuation-in-part of Ser. No. 300,417, Jan. 23, 1989.

[51] Int. Cl.[4] ..... F01N 1/08; F01N 7/18

[52] U.S. Cl. ..... 181/282; 181/228; 181/243; 181/272

[58] Field of Search ..... 181/228, 232, 238, 243, 181/250, 268, 272, 273, 282

[56] References Cited

U.S. PATENT DOCUMENTS

| | | | |
|---|---|---|---|
| 705,357 | 7/1902 | Keating . | |
| 1,110,040 | 9/1914 | Chatain . | |
| 2,484,826 | 10/1949 | Harley . | |
| 2,484,827 | 10/1949 | Harley . | |
| 2,658,580 | 11/1953 | Trembley . | |
| 2,860,722 | 11/1958 | Gerstung . | |
| 2,902,109 | 9/1959 | Burgess et al. . | |
| 2,943,695 | 7/1960 | Jeffords | 181/243 |
| 3,125,182 | 3/1964 | Earley . | |
| 3,140,755 | 7/1964 | Tranel | 181/282 |
| 3,158,222 | 11/1964 | Richmond | 181/273 |
| 3,176,791 | 4/1965 | Betts et al. | 181/260 |
| 3,198,284 | 8/1965 | Powers . | |
| 3,220,508 | 11/1965 | Nordquest et al. . | |
| 3,412,825 | 11/1968 | Hall . | |
| 3,638,756 | 2/1972 | Thiele | 181/245 |
| 3,650,354 | 3/1972 | Gordon . | |
| 3,709,320 | 1/1973 | Höllerl et al. . | |
| 3,827,529 | 8/1974 | Frietzsche et al. . | |
| 3,852,041 | 12/1974 | Moore et al. | 60/299 X |
| 4,108,274 | 8/1978 | Snyder | 181/229 |
| 4,109,751 | 8/1978 | Kabele | 181/247 |
| 4,132,286 | 1/1979 | Hasui et al. | 181/265 |
| 4,165,798 | 8/1979 | Martinez | 181/268 |
| 4,396,090 | 8/1983 | Wolfhugel | 181/282 |
| 4,415,059 | 11/1983 | Hayashi | 181/250 |
| 4,418,790 | 12/1983 | Agnew | 181/268 |
| 4,422,519 | 12/1983 | Nomura et al. | 180/219 |
| 4,456,091 | 6/1984 | Blanchot | 181/282 |
| 4,523,660 | 6/1985 | Gaddi | 180/228 |
| 4,700,806 | 10/1987 | Harwood | 181/282 |
| 4,759,423 | 7/1988 | Harwood et al. | 181/282 |
| 4,760,894 | 8/1988 | Harwood et al. | 181/282 |
| 4,765,437 | 8/1988 | Harwood et al. | 181/282 |

FOREIGN PATENT DOCUMENTS

| | | |
|---|---|---|
| 59-155528 | 9/1984 | Japan . |
| 59-43456 | 12/1984 | Japan . |
| 61155625 | 3/1985 | Japan . |
| 60-111011 | 6/1985 | Japan . |
| 61-14565 | 5/1986 | Japan . |
| 61-108821 | 5/1986 | Japan . |
| 632013 | 1/1950 | United Kingdom . |
| 1012463 | 12/1965 | United Kingdom . |
| 2120318 | 11/1983 | United Kingdom . |

*Primary Examiner*—Benjamin R. Fuller

*Attorney, Agent, or Firm*—Anthony J. Casella; Gerald E. Hespos

[57] ABSTRACT

A light weight exhaust muffler is provided comprising a pair of formed external shells and a pair of pipes disposed therein. The external shells are formed to include peripheral portions and chambers extending from the peripheral portions. The chambers are separated from one another by baffle creases unitary with the respective external shells. Portions of the baffle creases of one external shell are secured in face-to-face contact with corresponding portions of the baffle creases in the other external shell. The baffle creases comprise arcuate portions corresponding to the shape of the pipes passing between the chambers separated by the baffle creases.

11 Claims, 3 Drawing Sheets

LIGHT WEIGHT HYBRID EXHAUST MUFFLER AND METHOD OF MANUFACTURE

CROSS-REFERENCE TO RELATED APPLICATION

This application is a continuation-in-part of application Ser. No. 300,417 which was filed on Jan. 23, 1989, by David Garey, and which is entitled "LIGHT WEIGHT HYBRID EXHAUST MUFFLER".

BACKGROUND OF THE INVENTION

A vehicular exhaust system comprises one or more pipes for carrying exhaust gases from the engine. Each pipe extending from the engine may lead to a catalytic converter which is operative to convert certain objectionable gases in the exhaust stream into less objectionable forms. An exhaust pipe extends from the catalytic converter to a muffler which is operative to attenuate the noise associated with flow of exhaust gases. A tail pipe then extends from the muffler to a location on the vehicle where the exhaust gases can be safely and conveniently released.

The typical prior art exhaust muffler comprises a plurality of separate tubes supported in a parallel array by a plurality of transversely extending baffles. Selected portions of each tube may comprise perforations, louvers or apertures to permit exhaust gases traveling therethrough to escape in a controlled manner. Each tube typically is securely connected to at least one baffle and the array of assembled parallel tubes and transverse baffles are then slid into a generally tubular shell having a circular or oval cross-sectional configuration which corresponds to the shape of the baffles. A separate outer wrapper typically is wrapped around the outer shell to dampen noise associated with the vibration of the shell. A pair of opposed end caps or headers are then securely connected to the opposed longitudinal ends of the tubular shell and outer wrapper to substantially enclose the muffler. Each end cap typically comprises at least one aperture to permit communication with the internal portions of the muffler. The apertures in the end caps typically are aligned to mate with one of the tubes within the muffler. The assembly of components in this typical prior art muffler defines a plurality of chambers. In particular, chambers are defined between the tubular shell and either a pair of spaced apart baffles or between one baffle and one end cap of the prior art muffler. The relative spacing of the baffles in the muffler, the dimensions of the tubes therein and the dimensions of the perforations, louvers, apertures or the like are all selected to enable a specified attenuation of exhaust gas noise. More particularly, the exhaust gas flowing through the system expands through the various perforations, louvers, apertures or the like and into the corresponding chambers to achieve the specified noise attenuation.

When the above described exhaust muffler is intended for an original equipment installation, the muffler typically is welded to the elongated circuitous exhaust pipe and tail pipe. The assembly of the muffler, the exhaust pipe and the tail pipe is then delivered to the original equipment vehicle manufacturer, such that the complete exhaust system assembly can be mounted to the vehicle.

The prior art mufflers and exhaust system components described above generally have provided adequate attenuation of noise associated with the flow of exhaust gas. However, the prior art exhaust muffler has required a large number of separate components which had to be assembled in a labor intensive manufacturing process. The resulting muffler tended to be unnecessarily heavy and offered few design options pertaining to the shape of the muffler or the alignment of pipes leading to or away from the muffler. These inherent limitations with the above described prior art mufflers have made it extremely difficult to fit the exhaust system into the limited available space on the underside of the vehicle.

The prior art further includes mufflers which comprise stamp formed components. For example, U.S. Pat. No. 4,396,090 which issued to Wolfhugel on Aug. 2, 1983 shows a muffler having a pair of internal plates stamp formed to define pairs of opposed channels. The internal plates are assembled such that the channels are in register with one another and define tubes therebetween. The internal plates are then disposed within the above described conventional wrapped outer shell to define a muffler. Separate internal baffles extend between the stamped plates and the wrapped outer shell to define chambers within the muffler of U.S. Pat. No. 4,396,090.

The prior art also includes mufflers consisting of only two opposed shells which are stamped to define a convoluted array of stamp formed tubes and stamp formed chambers. Mufflers of this type are shown in: U.S. Pat. No. 2,484,827 which issued to Harley on Oct. 18, 1949; U.S. Pat. No. 3,176,791 which issued to Betts et al. on Apr. 6, 1965 and U.S. Pat. No. 3,638,756 which issued to Thiele on Feb. 1, 1972.

The prior art further includes mufflers that are formed from four stamped components. Mufflers of this type comprise a pair of internal plates that are stamped to define opposed channels. The plates are secured in face-to-face relationship with one another such that tubes are defined by the opposed channels. The internal plates are further provided with stamp formed perforations, louvers or the like to permit expansion of the exhaust gas from the formed tubes. These mufflers further comprise a pair of stamp formed external shells which define a chamber surrounding and enclosing the internal plates. The chambers define a single enclosed volume into which the exhaust gases may expand. Prior art mufflers of this general type are shown in: British Patent No. 632,013 which issued to White in 1949; British Patent No. 1,012,463 which issued to Woolgar on Dec. 8, 1965; and U.S. Pat. No. 4,132,286 which issued to Hasui et al. on Jan. 2, 1979.

Certain prior art mufflers have been formed from three or more stamped components plus a plurality of tubular components. For example, the above cited U.S. Pat. No. 4,132,286 to Hasui shows a muffler having a perforated internal plate which is stamped to define at least one channel. Conventional tubular members conforming to the shape of the channels in the perforated plate are supported by and retained in the channels. The muffler of U.S. Pat. No. 4,132,286 further comprises a pair of opposed stamp formed external shells effectively defining a clam shell to surround the perforated internal plate and the tubes supported therein. The muffler shown in U.S. Pat. No. 4,132,286 effectively defines only a single internal chamber into which exhaust gases expand. The acoustical tuning capabilities of a muffler of this general type are very limited, and it would be extremely difficult for a muffler as shown in U.S. Pat.

No. 4,132,286 to achieve the noise attenuation requirements of mufflers for most vehicles manufactured or sold in the United States.

A muffler similar to the muffler shown in the above cited U.S. Pat. No. 4,132,286 is shown in British Patent No. 2,120,318 which issued to Allday on Nov. 30, 1983. In particular, British Patent No. 2,120,318 shows a muffler having a plurality of tubes supported in a parallel array by a plurality of tranversely extending baffles. The array of tubes and the baffles are disposed in opposed stamp formed external shells of generally clam shell configuration. However, the external shells shown in British Patent No. 2,120,318 are part of extremely complex stampings which further define both a stamp formed exhaust pipe and a stamp formed tail pipe. The stamped external clam shells and the stamped exhaust pipe and tail pipe unitary therewith would require extremely expensive dies. Furthermore, the internal components required by British Patent No. 2,120,318 inherently require the combination of tubes and separate baffles which must be assembled in the labor intensive manufacturing processes described with respect to the traditional prior art muffler.

Still another prior art muffler incorporating both tubular and stamped components is shown in published Japanese patent application No. 59-43456. Unlike the two previously described references, the muffler shown in Japanese application No. 59-43456 includes at least four stamped components in combination with tubular members. In particular, the muffler shown in Japanese patent application No. 59-43456 includes a pair of stamped internal plates with formed channels that define tubes when the internal plates are disposed in face-to-face relationship. Additionally, portions of each internal plate are folded generally orthogonal to the remainder of the plates to define a wall extending transverse to the stamp formed tubes. Separate stamp formed baffles also are provided. The muffler shown in published Japanese patent application No. 59-43456 further comprises a pair of stamp formed exterior clam shells which surround the internal plates. The external clam shells and the folded portions of the internal plate define complementary configurations, such that the folded portions of the internal plates define baffles within the muffler. The muffler further includes tubular members which extend between the external shell and the baffles formed by the folded portions of the internal plates. The muffler shown in Japanese patent application No. 59-43456 is extremely complex, expensive and could be difficult to assemble. In particular, this muffler includes at least four stamped components with corresponding dedicated dies plus a pair of separate tubular members. It is believed that the stamped internal plates would have to be assembled and welded to one another. The separate tubular members would then have to be securely connected to the stamped internal plates by welding or the like. The separate baffles would also have to be securely connected to the stamped internal plates. The opposed exterior clam shells would then have to be securely assembled around the subassembly consisting of the opposed stamped internal plates, the separate baffles and the separate tubes.

The above described prior art stamp formed mufflers provide certain advantages over the conventional mufflers with wrapped outer shells. In particular, many of the above described stamp formed mufflers would be lighter than conventional mufflers and could be manufactured in processes that are well suited to automation. However, most of the above described prior art stamp formed mufflers generally did not provide a level of acoustical tuning that would be acceptable on vehicles manufactured or sold in the United States. As a result, until recently, stamp formed mufflers did not achieve significant commercial success in the United States.

Recently there have been several substantial advances in the stamp formed muffler art. In particular, U.S. Pat. No. 4,700,806 which issued to Jon Harwood on Oct. 20, 1987 shows a muffler formed from stamp formed components and providing the combination of at least one tuning tube and at least one low frequency resonating chamber. One embodiment of the mufflers shown in U.S. Pat. No. 4,700,806 shows a pair of internal plates formed to define channels therein. The plates are secured to one another such that arrays of tubes are defined by the channels. Selected portions of the channels are provided with perforations or other such aperture means for permitting a controlled expansion of the exhaust gases flowing through the formed tubes. The muffler of U.S. Pat. No. 4,700,806 further comprises a pair of external shells. In the above referenced embodiment, the external shells comprise a peripheral portion and a crease connecting spaced apart locations on the peripheral portions. The crease is formed to be in contact with the internal plate substantially continuously between the peripheral portions of the external shell. Thus, the crease shown in U.S. Pat. No. 4,700,806 effectively defines a baffle which enables a plurality of chambers to be defined by the external shell. The location of the crease shown in U.S. Pat. No. 4,700,806 is selected in accordance with the volume of the chambers required for the specified noise attenuation and exhaust gas flow characteristics.

Other improvements relating to stamp formed mufflers are shown in U.S. Pat. No. 4,736,817 which issued to Jon Harwood on Apr. 12, 1988; U.S. Pat. No. 4,759,423 which issued to Jon Harwood et al. on July 26, 1988; U.S. Pat. No. 4,760,894 which issued to Jon Harwood et al. on Aug. 2, 1988; and, U.S. Pat. No. 4,765,437 which issued to Jon Harwood et al. on Aug. 23, 1988. All of the above described Harwood patents are assigned to the assignee of the subject invention, and the disclosures thereof are incorporated herein by reference.

Mufflers manufactured in accordance with the above described Harwood patents have achieved considerable commercial success in a very short time. All of this commercial success relates to original equipment mufflers where the number of mufflers of a particular type have been sufficient to readily offset the costs associated with the stamping dies. It is anticipated, however, that there may be some situations where the volume of mufflers may be small, thereby increasing the per muffler costs associated with the four stamping dies required for four stamp formed components of a muffler. It is also anticipated that in some situations the exhaust gas flow will require fairly uncomplicated acoustical tuning. For these situations, it is desired to provide a muffler that can be manufactured with very low initial manufacturing costs and low material costs, while still providing the very desirable advantages of a manufacturing process that is well suited to automation. Furthermore, it is well known that weight reductions can improve fuel efficiency and other aspects of engine performance. Therefore, it is desirable to provide lower weight vehicular components whenever possible.

Accordingly, it is an object of the subject invention to provide an exhaust muffler having a substantially minimal number of components.

It is another object of the subject invention to provide a very light weight muffler and exhaust system.

An additional object of the subject invention is to provide a muffler with stamp formed components but with low die costs.

Still a further object of the subject invention is to provide a muffler which facilitates automated welding of the muffler components.

Another object of the subject invention is to provide a muffler with baffles of integral construction and unitary with the external shell for supporting tubular components of the muffler.

SUMMARY OF THE INVENTION

The subject invention is directed to an exhaust muffler comprising a pair of opposed external shells each of which is formed to define a plurality of chambers. The external shells may be formed by stamping or other known metal forming techniques. Each external shell is formed to define a peripheral portion which may be a peripheral flange. The peripheral portion may be disposed to lie generally in a single plane. The peripheral portions of the two formed external shells may be dimensioned to be placed generally in register with one another to enable the opposed peripheral portions to be securely connected to one another.

The external shells further are formed to define at least one baffle crease extending between and connecting a pair of spaced apart peripheral portions of the external shell. The base of the baffle creases include a plurality of non-linear portions at least some of which may be dimensioned to surround and closely engage tubes within the muffler, as explained herein. The creases in the external shells may be disposed to be placed generally in register with one another such that portions of the base of a baffle crease in one external shell are in face-to-face contact with corresponding portions of the base of a baffle crease in the other external shell. Each external shell may comprise a plurality of baffle creases, with each crease in one external shell being generally in register with a corresponding crease in the other external shell. Portions of the base of each such baffle crease in one external shell may be in contact with corresponding portions of the base of the respective baffle creases in the other external shell. The non-linear portions of the baffle creases may b any configuration but preferably may be substantially semi-circular or semi-cylindrical and may be dimensioned to closely engage a substantially cylindrical tube. Selected nonlinear portions of the baffle creases may be dimensioned to provide controlled communication between chambers. In particular, non-linear portions of the baffle creases may define stamp formed tubes.

Portions of the external shells may further be formed to engage at least one inlet pipe to the muffler and at least one outlet pipe from the muffler. The portions of the external shells for engaging the inlet and outlet pipes may be substantially adjacent peripheral portions of each external shell and may be substantially semi-circular or semi-cylindrical or other suitable configuration to conform to the shape of the pipes.

Remaining portions of the external shells may define a shape which is selected to conform to the available space on a vehicle. At least one of the external shells may include a concave conformal area which is shaped to conform to a convex structure on the vehicle. The external shells may be mirror images of one another to enable a pair of mateable external shells to be formed from a single set of stamping dies.

The muffler further comprises an array of tubes disposed at least partly within the muffler. The tubes in the array are supported within the external shell by the non-linear portions of the baffle creases formed in the external shell. At least selected tubes may further be supported by the inlet and outlet portions of the external shell. Selected portions of each tube may be provided with arrays of perforations, louvers, apertures or the like to permit a controlled flow and/or expansion of exhaust gases therefrom and into an expansion chamber defined in part by baffle creases of the external shells. At least one tube within the muffler may define a tuning tube which is disposed to communicate with an enclosed low frequency resonating chamber defined in part by the baffle creases of the external shells. At least one tube may extend externally from the muffler to define a continuous unitary exhaust pipe or tail pipe. Portions of the continuous unitary exhaust pipe and/or tail pipe disposed within the muffler may comprise the above described perforations, louvers, apertures or other means to permit a flow of exhaust gas therefrom. Portions of the continuous exhaust pipes or tail pipes disposed within the muffler and/or portions thereof disposed external to the muffler may be non-linear.

The external shells are securely engaged to one another and around the tubes of the muffler. The external shells preferably are secured directly to one another at least at selected locations along portions of the baffle creases which are in face-to-face contact with one another. Thus, opposed baffle creases will structurally and functionally define an integral baffle, but will further be unitary with the respective external shells. The secure connection of the external shells to one another may be by welding or by an appropriate mechanical connection means.

A preferred manufacturing and assembly method includes the formation of the inlet and outlet portions of external shells to be aligned with selected non-linear portions of the baffle creases. The external shells are then connected to one another by welding or appropriate mechanical interconnection means. The tubes having apertures, louvers or the like formed therein are then inserted into the inlet or outlet openings a sufficient distance to pass through and be supported by the non-linear portion of the baffle crease aligned therewith. The tubes may then be welded to peripheral portions of the external shells.

DETAILED DESCRIPTION OF THE PREFERRED EMBODIMENTS

Figure 1:
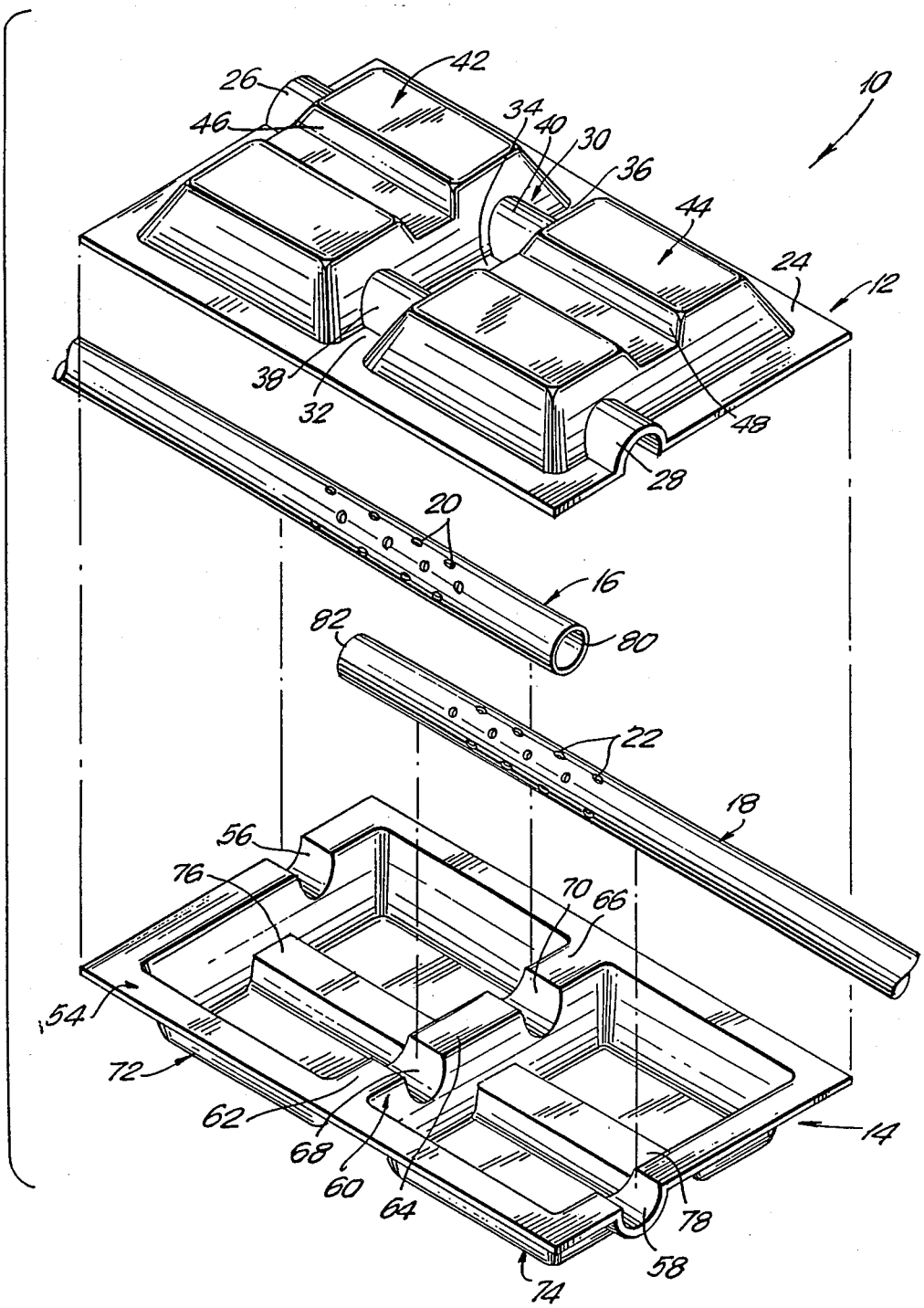
FIG. 1 is an exploded perspective view of a muffler in accordance with the subject application.
Figure 2:
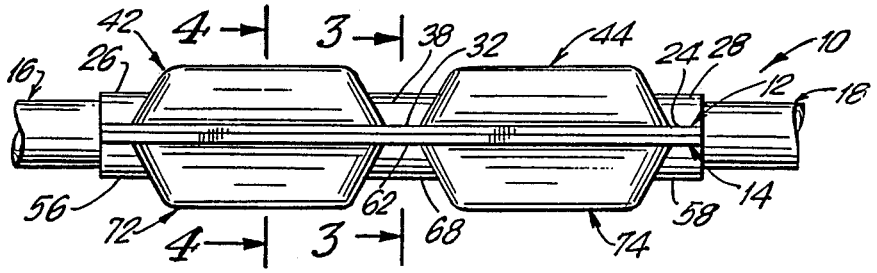
FIG. 2 is a side elevational view of the muffler of FIG. 1 shown in its assembled form.
Figure 3:
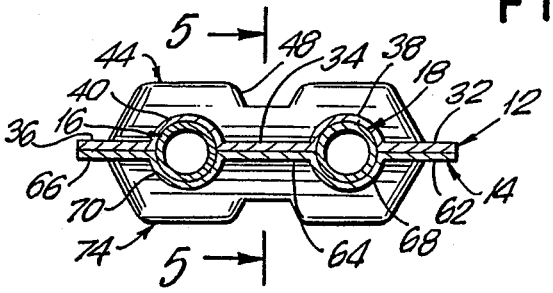
FIG. 3 is a cross-sectional view taken along line 3—3 in FIG. 2.
Figure 4:
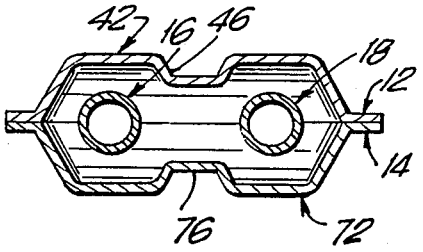
FIG. 4 is a cross-sectional view taken along line 4—4 in FIG. 2.
Figure 5:
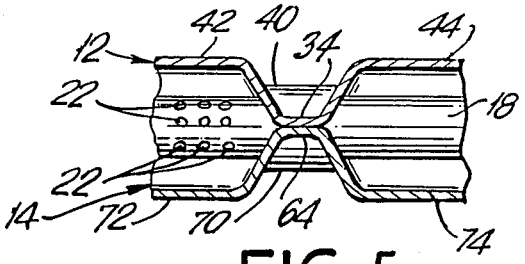
FIG. 5 is a cross-sectional view taken along line 5—5 in FIG. 3.

A muffler in accordance with the subject invention is identified generally by the numeral 10 in FIGS. 1–5. The muffler 10 comprises external shells 12 and 14 which are formed from unitary sheets of metal such as aluminized steel, galvanized steel or stainless steel or from suitable nonmetallic materials. The muffler 10 further comprises tubes 16 and 18 which are disposed at least partly within the muffler 10. As depicted herein, the tubes 16 and 18 extend unitarily to external locations relative to the muffler 10 and define at least portions of an exhaust pipe and tail pipe respectively. However, in certain embodiments, the tubes 16 and 18 will terminate substantially adjacent the periphery of the muffler 10, thereby defining an inlet and an outlet for the muffler. At least one separate exhaust pipe and tail pipe will then be connected to the inlet and outlet of the muffler. Portions of the tubes 16 and 18 disposed within the muffler 10 are provided with perforations 20 and 22 which are selectively dimensioned and disposed to permit a controlled flow of exhaust gases from the tubes 16 and 18, as explained herein. It is to be understood that in accordance with normal practice in the industry, the perforations 20 and 22 may be replaced by other means for permitting the expansion of exhaust gases, such as louvers, apertures or the like.

The external shells 12 and 14 are depicted as being substantially mirror images of one another. As a result, a single stamping die may be employed to form both the external shell 12 and the external shell 14. The use of substantially identical external shells 12 and 14 further simplifies inventory control. In many embodiments, however, the mirror image configuration of the external shells 12 and 14 will not be possible, and differences will be required in accordance with the specification of the vehicle. It is envisioned, however, that in these instances, the external shells will be stamp formed employing insert dies and die subsets, as explained in co-pending application Ser. No. 259,176. The proper use of die subsets and inserts can substantially reduce the investment in dies for stamping external shells of similar but different shapes.

The external shell 12 comprises a generally planar peripheral flange 24. An arcuate inlet flange 26 and an arcuate outlet flange 28 extend away from the planar portions of the peripheral flange 24 and will define portions of the inlet and outlet to the muffler 10 as explained further below. The external shell 12 further comprises a baffle crease 30 which connects spaced apart locations on the peripheral flange 24. More particularly, the baffle crease 30 comprises planar base portions 32, 34 and 36 and arcuate portions 38 and 40. The planar base portions 32, 34 and 36 of the baffle crease 30 lie generally in the same plane as the peripheral flange 24. However, the arcuate portions 38 and 40 extend from the plane of the peripheral flange 24, and are dimensioned to engage the tubes 16 and 18 as explained further below.

The external shell 12 is further characterized by formed chambers 42 and 44 which extend from the plane defined by the peripheral flange 24. The chambers 42 and 44 are characterized respectively by concave portions 46 and 48 which are dimensioned to substantially conform to the configuration of a convex structure on the vehicle to which the muffler 10 is mounted. The concave portions 46 and 48 further function to reinforce the chambers 42 and 44, and may thereby reduce noise related to the vibration of the external shell 12. However, it is envisioned that in many embodiments of the muffler 10, the external shell 12 and the external shell 14 will be provided with a plurality of stiffening grooves such as those shown in co-pending application Ser. No. 227,807.

The external shell 14 as depicted in FIGS. 1–5 is substantially a mirror image of the external shell 12. However, this mirror image configuration of the external shells 12 and 14 is not essential, and will not be possible on many mufflers. The external shell 14 comprises a generally planar peripheral flange 54 which is dimensioned to be placed substantially in register with the peripheral flange 24 of the external shell 12. The peripheral flange 54 is characterized by inlet and outlet flanges 56 and 58 which are disposed to be placed in register with the inlet and outlet flanges 26 and 28 on the external shell 12. The external shell 14 further comprises a baffle crease 60 defined by generally planar portions 62, 64 and 66 and by arcuate portions 68 and 70. The planar portions 62, 64 and 66 of the baffle crease 60 lie within the same plane as the planar peripheral flange 54 and are disposed and dimensioned to be placed in face-to-face contact with the planar portions 32–36 of the baffle crease 30 on the external shell 12. Similarly, the arcuate portions 68 and 70 of the baffle crease 60 are disposed to be placed generally in register with the arcuate portions 38 and 40 of the baffle crease 30 on the external shell 12.

The external shell 14 further comprises chambers 72 and 74 extending from the peripheral flange 54. The chambers 72 and 74 are characterized respectively by concave inwardly formed portions 76 and 78 respectively. In the typical muffler, it will not be necessary to provide conformal portions on opposed external shells. However, the provision of the conformal portions 76 and 78 may be employed to both contribute to a stiffening of the external shell 14 and to enable the use of substantial identical die subsets for forming the external shells 12 and 14.

The muffler 10 may be assembled into the form shown in FIGS. 2–5 by initially positioning the exhaust pipe 16 and tail pipe 18 into proper location in the external shell 14. In particular, the exhaust pipe 16 is mounted into the arcuate inlet flange 56 and the arcuate portion 70 of the baffle crease 60 such that the array of perforations 20 is disposed substantially in alignment with the chamber 72, and such that the extreme end 80 of the exhaust pipe 16 is disposed within the chamber 74. Similarly, the tail pipe 18 is mounted in the outlet flange 58 and the arcuate portion 68 of the baffle crease 60. The array of perforations 22 is disposed to lie within the chamber 74, while the end 82 of the tail pipe 18 will be disposed within the chamber 72.

The external shell 12 is then mounted to the external shell 14 such that the peripheral flanges 24 and 54 respectively are generally in register and in face-to-face relationship. In this orientation, the inlet and outlet flanges 26 and 28 of the external shell 12 will surround and engage the exhaust pipe 16 and tail pipe 18 respectively. Additionally, the arcuate portions 38 and 40 of the baffle crease 30 in the external shell 12 will substantially surround and engage the tail pipe 18 and the exhaust pipe 16 respectively. In this assembled condition, the planar portions 32, 34 and 36 of the baffle crease 30 will be in substantially face-to-face contact with the planar portions 62, 64 and 66 respectively of the baffle crease 60. The juxtaposed planar portions 32–36 and 62–66 respectively will then be securely connected to one another by, for example, spot welding. In a preferred embodiment, a plurality of spot welds will be employed to interconnect each juxtaposed pair of planar surfaces 32–36 and 62–66 respectively.

The assembly is completed by securely connecting the external shells 12 and 14 to one another around the respective peripheral flanges 24 and 54. The connection of the peripheral flanges 24 and 54 may be by welding, such as seam welding. The presence of only a double thickness of metal both at the peripheral flanges 24 and 54 and at the planar portions 32–36 and 62–66 provides for relatively easy welding. The exhaust pipe 16 may then be securely welded to the inlet flanges 26 and 56 while the tail pipe 18 may similarly be welded to the outlet flanges 28 and 58. This weldment of the exhaust and tail pipe 16 and 18 to remaining portions of the muffler 10 may readily be carried out with robotic welding equipment.

As an alternative to the above described assembly process, in some instances it may be possible to securely connect the external shells 12 and 14 to one another prior to placement of the exhaust pipe 16 and tail pipe 18 therein. The exhaust pipe 16 may then slidably be inserted between the inlet flanges 26 and 56 a sufficient distance to be appropriately supported by the arcuate portions 40 and 70 of the baffle creases 30 and 60 respectively. Similarly, the tail pipe 18 could be slidably inserted between the outlet flanges 28 and 58 a sufficient distance to be supported by the arcuate portions 38 and 68 of the respective baffle creases 30 and 60. The exhaust pipe 16 and the tail pipe 18 could then be securely connected to the inlet flanges 26, 56 and the outlet flanges 28, 58 by, for example, welding. With this embodiment, the exhaust pipe 16 and tail pipe 18 may be supported by the creases 30 and 60 but not mechanically connected thereto. Thus, the exhaust pipe 16 and tail pipe 18 may readily expand in response to the heat generated by the flow of exhaust gases through the muffler 10.

It should be emphasized that the muffler 10 shown most clearly in FIGS. 2–5 provides a very simple construction of low weight and a substantial minimum amount of metal and with a very simple manufacturing process. In particular, unlike many prior art mufflers, the muffler 10 does not include planar sheet metal portions extending between the tubes and peripheral portions of the muffler. Rather, the tubes are unitary structures that are completely spaced from peripheral portions of the muffler at all locations except the inlet and outlet. Additionally, unlike certain prior art mufflers, the muffler depicted most clearly in FIG. 5 includes a baffle defined by the baffle creases 30 and 60 which are unitary with the respective external shells 12 and 14. Thus, it is unnecessary to provide separate baffle members which had been employed in prior art mufflers having tubular internal components. The provision of the baffle creases 30 and 60 unitary with the external shells 12 and 14 substantially reduces the number of components required for the muffler and greatly facilitates the assembly of the muffler. Furthermore, the secure attachment of the opposed baffle creases 30 and 60 to one another contributes to the backfire resistance of the muffler.

Figure 6:
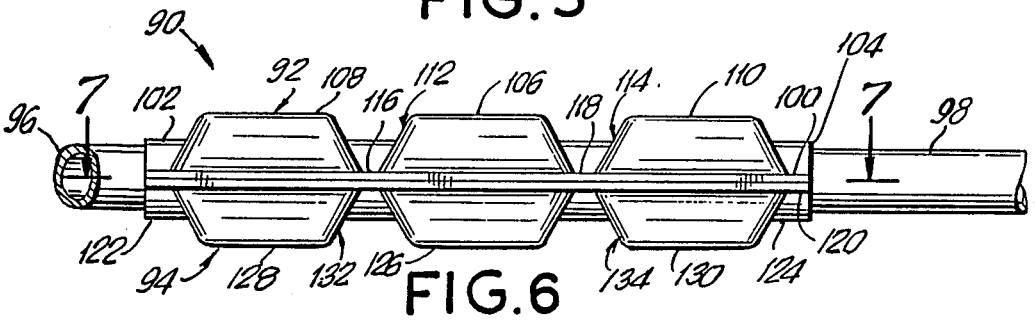
FIG. 6 is a side elevational view of a second embodiment of a muffler in accordance with the subject invention.
Figure 7:
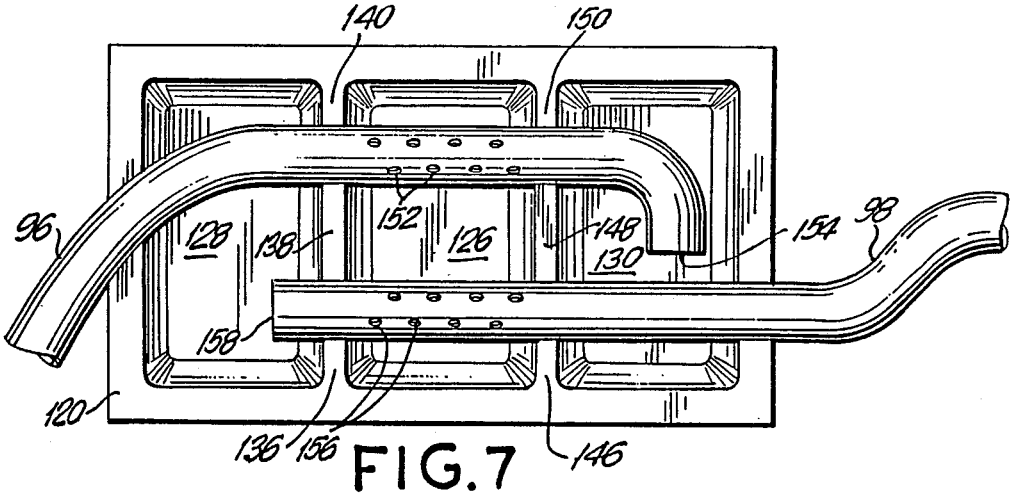
FIG. 7 is a cross-sectional view taken along line 7—7 in FIG. 6.

An alternate and slightly more complex muffler 90 is depicted in FIGS. 6 and 7. The muffler 90 comprises opposed external shells 92 and 94, an exhaust pipe 96 and a tail pipe 98. The external shell 92 is formed to define a generally planar peripheral flange 100 having an arcuate inlet flange 102 and an arcuate outlet flange 104. The external shell 92 further is formed to define a generally centrally located expansion chamber 106 and low frequency resonating chambers 108 and 110. Baffle creases 112 and 114 separate the expansion chamber 106 from the low frequency resonating chambers 108 and 110 respectively. The creases 112 and 114 comprise planar portions 116 and 118 respectively which lie generally in the same plane as the peripheral flange 100. Additionally, as explained in the previous embodiment, the creases 112 and 114 are provided with arcuate portions for engaging the respective exhaust pipe 96 and tail pipe 98.

The external shell 94 comprises a generally planar peripheral flange 120 having an arcuate inlet flange 122 and an arcuate outlet flange 124. A generally centrally disposed expansion chamber 126 and low frequency resonating chambers 128 and 130 extend from the peripheral flange 120. The expansion chamber 126 is separated from the low frequency resonating chambers 128 and 130 by baffle creases 132 and 134 respectively. As shown most clearly in FIG. 7, the baffle crease 132 is defined by planar portions 136, 138 and 140 which lie generally in the same plane as the peripheral flange 120. Arcuate portions are disposed in the crease 132 and extend from the plane defined by the peripheral flange 120 for supporting the exhaust pipe 96 and tail pipe 98. In a similar manner, and as shown most clearly in FIG. 7, the baffle crease 134 comprises planar portions 146, 148 and 150 which lie within the plane of the peripheral flange 120, and arcuate portions which extend from the plane of the peripheral flange 120 for supporting the exhaust pipe 96 and the tail pipe 98. The baffle creases 132 and 134 of the external shell 94 are disposed to be substantially in register with the above described baffle creases 112 and 114 of the external shell 92. Thus, the expansion chamber 126 of the external shell 94 will be generally in register with the expansion chamber 106 of the external shell 92. Furthermore, the low frequency resonating chambers 128 and 130 of the external shell 94 will be in register with the corresponding low frequency resonating chambers 108 and 110 of the external shell 92.

The exhaust pipe 96 comprises an array of perforations 152 disposed to lie within the expansion chamber 106, 126. The portion of the exhaust pipe 96 disposed to lie within the low frequency resonating chamber 110, 130 is substantially free of perforations and is bent to achieve a length that will properly attenuate a selected narrow range of low frequency sound. The end 154 of the exhaust pipe 96 is disposed to lie within the low frequency resonating chamber 110, 130.

In a similar manner, the tail pipe 98 is provided with an array of perforations 156 which are disposed to lie within the expansion chamber 106, 126. The portion of the tail pipe 98 disposed in line with the low frequency resonating chamber 108, 128 is substantially free of perforations and is substantially linear. The extreme end 158 of the tail pipe 98 is disposed to lie within the low frequency resonating chamber 108, 128.

It will further be noted that in the embodiment of the muffler depicted most clearly in FIG. 7, the exhaust pipe 96 and the tail pipe 98 include curved portions external to the muffler 90 including a curve at the inlet to the muffler. The particular orientation of the curves in the exhaust pipe 96 and the tail pipe 98 will depend upon the configuration of the available space on the underside of the vehicle.

The muffler 90 is assembled substantially as the muffler 10 described above. In its assembled condition, the external shells 92 and 94 are securely connected to one another both at the planar portions of the baffle creases 112, 114, 132, 134 and around the peripheral flanges 100 and 120. In this embodiment, the baffle creases 112 and 132 function as an integral baffle which separates the expansion chamber 106, 126 from the low frequency resonating chamber 108, 128. Similarly, the baffle creases 114, 134 function as an integral baffle to separate the expansion chamber 106, 126 from the low frequency resonating chamber 110, 130. As described for the previous embodiment, the respective baffles are unitary with remaining portions of the external shells 92 and 94, thereby substantially simplifying the muffler 90 as compared to the prior art mufflers that have included separate baffles.

In the assembled muffler 90, the exhaust pipe 96 terminates in the low frequency resonating chamber 110, 130 to function as a tuning tube that will attenuate a fairly narrow low frequency range of noise. The specific frequency will be determined in part by the volume defined by the low frequency resonating chamber 110, 130, by the cross-sectional area of the pipe 96 and by the distance between the perforations 152 and the end 154 of the exhaust pipe. Similarly, the end of the tail pipe 98 functions as a tuning tube which leads into the low frequency resonating chamber 108, 128. Exhaust gas will flow through the exhaust pipe 96 and into the expansion chamber 106, 126 through the perforations 152. The flow of exhaust gases will continue through the perforations 156 in the tail pipe 98. The volume of flow of exhaust gas will determine the cross-sectional area of the exhaust pipe 96 and tail pipe 98 as well as the total area required for the perforations 152 and 156. In certain embodiments, configurations other than circular perforations 152 and 156 may be desired, such as louvers or larger apertures.

Figure 9:
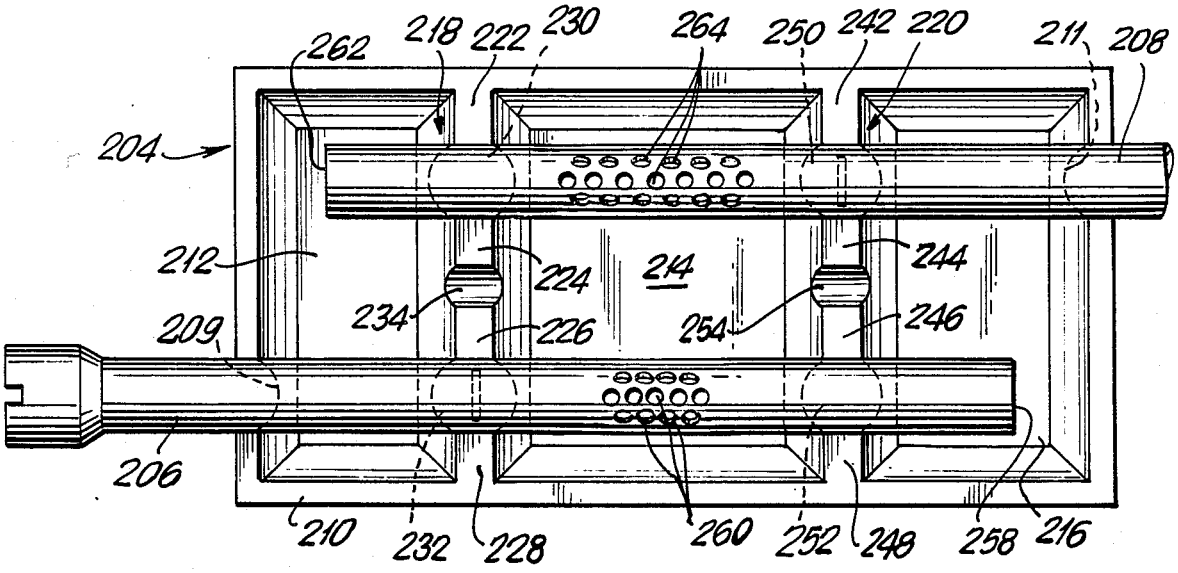
FIG. 9 is a cross-sectional view taken along line 9—9 in FIG. 8.
Figure 8:
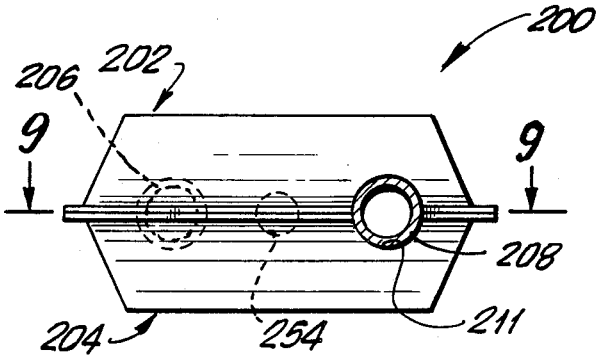
FIG. 8 is an end view of a third embodiment of a muffler in accordance with the subject invention.

Another alternate muffler is illustrated in FIGS. 8 and 9, and is identified generally by the numeral 200. The side elevational view of the muffler 200 is substantially the same as the side elevational view of the muffler 90 as depicted in FIG. 6. More particularly, the muffler 200 includes first and second external shells 202 and 204, an exhaust pipe 206 and a tail pipe 208. To facilitate this explanation, it is assumed that the external shells 202 and 204 are substantially identical and symmetrical about two orthogonal axes. However, in most actual embodiments of the muffler, this symmetry will be substantially precluded by the shape of the available space envelope on the vehicle.

With reference to FIG. 9, the external shell 204 is stamp formed to define a generally planar peripheral flange 210 from which generally semi-cylindrical inlet and outlet channels 209 and 211 extend. Chambers 212, 214 and 216 also are formed to extend from the plane of the peripheral flange. As in the above described embodiments, the volume of the chambers 212–216 will be dependent largely on the exhaust flow and noise characteristics of the engine, while the shape of the chambers 212–216 will be dependent upon the shape of the available space on the vehicle. The chambers 212 and 214 are separated from one another by baffle crease 218, while the chambers 214 and 216 are separated from one another by baffle crease 220. The baffle crease 218 is characterized by generally planar portions 222, 224, 226 and 228 which lie generally within the same plane as the peripheral flange 210. The baffle crease 218 is further characterized by nonplanar portions 230, 232 and 234. As illustrated in FIG. 9, the nonplanar portions 230 and 232 of the baffle crease 218 are disposed on opposite respective sides of the nonplanar portion 234.

The baffle crease 220 is characterized by substantially planar portions 242, 244, 246 and 248 and by nonplanar portions 250, 252 and 254. The nonplanar portions 250 and 252 are disposed on opposite respective sides of the nonplanar portion 254. Additionally, the nonplanar portion 250 is in generally colinear relationship with the nonplanar portion 230 and with the outlet channel 211, while the nonplanar portion 252 is in generally colinear relationship with the nonplanar portion 232 and with the inlet channel 209. Furthermore, nonplanar portions 230 and 250 and the outlet channel 211 are of substantially identical size and shape, while nonplanar portions 232 and 252 and the inlet channel 209 are of substantially identical size and shape. In the typical embodiment, the nonplanar portions 230, 232, 250 and 252 and the inlet and outlet channels 209 and 211 will be of generally semi-cylindrical configuration, and will define cross sections substantially corresponding to the external dimensions of the exhaust pipe 206 and the tail pipe 208. The nonplanar portions 234 and 254 are depicted as being of smaller cross section than the nonplanar portions 230, 232, 250 and 252. However, the relative dimensions of the nonplanar portions are entirely dependent upon the exhaust flow and noise characteristics of the engine to which the muffler 200 is connected.

The exhaust pipe 206 is substantially linear within the muffler 200 and extends to a location external of the muffler 200. The external portion of the exhaust pipe 206 may be linear or non-linear depending upon the requirements of the exhaust system. The exhaust pipe 206 includes an end 258 which is disposed to lie within the chamber 216. The exhaust pipe 206 further comprises an array of perforations 260 disposed at selected locations therealong spaced inwardly from the end 258 of the exhaust pipe 206. The total area encompassed by the perforations 260 is selected in accordance with the noise attenuation requirements of the muffler 200. The perforations 260 are disposed to lie within the chamber 214. In a similar manner, the tail pipe 208 includes an end 262 disposed to lie within the chamber 212. The tail pipe 208 further comprises an array of perforations 264 which are disposed to lie within the chamber 214 of the muffler 210.

As noted above, the external shell 202 depicted in FIG. 8 is substantially identical to the external shell 204. However, dissimilarities between the external shells 202 and 204 are probable and the respective shape will be determined in accordance with the space availability on the vehicle. In most situations, however, the baffle creases 218 and 220 of the external shell 204 will be disposed to be substantially in register with corresponding baffle creases of the external shell 202. Additionally, the baffle creases of the external shell 202 will preferably include non-linear portions disposed to engage the exhaust pipe 202 and the tail pipe 208.

The muffler 200 is assembled by first securing the external shells 202 and 204 together about their peripheral flanges, and preferably at the opposed planar portions of the baffle creases 218 and 220. The inlet channel 209 of the external shell 204 and the opposed inlet channel of the external shell 202 will define an inlet to the muffler 200 as shown in FIG. 8. Similarly, the outlet channel 211 of the external shell 204 and the registered outlet channel of the external shell 202 will define an outlet from the muffler. The secure connection of the external shells 202 and 204 may be by welding or by appropriate mechanical interconnection means, such as crimping or roll forming.

The exhaust pipe 206 is then slidably inserted in an axial direction through the inlet and through the non-linear portions 232, 252 of the external shell 204 and the corresponding registered non-linear portions of the baffle creases in the external shell 202. In particular, the axial movement of the exhaust pipe 206 is sufficient to place the end 258 of the exhaust pipe 206 within the chamber 216, and to place the perforations 260 within the chamber 214.

In a similar manner, the tail pipe 208 is inserted axially into the outlet of the muffler 200, and through the non-linear portions 230 and 250 of the baffle creases 218 and 220 respectively and corresponding non-linear portions in the external shell 200. More particularly, the insertion of the tail pipe 208 into the muffler 200 is sufficient to place the end 262 of the tail pipe 208 within the chamber 212, and to place the perforations 264 within the chamber 214. The opposed external ends of the respective exhaust pipe 206 and tail pipe 208 will then be appropriately connected to other portions of the exhaust system.

The flow enabled by the muffler 200, as depicted most clearly in FIG. 9, is very similar to the well know triflow muffler that has been manufactured with a conventional wrapped outer shell, at least three tubes and an array of separate baffles. In particular, the portion of the exhaust gas traveling through the exhaust pipe 206 will bleed through the apertures 260 and into the chamber 214. The remaining exhaust gas will flow to the end 258 of the exhaust pipe 206 and will enter the chamber 216. Gas entering the chamber 216 will flow through the formed tube defined by the non-linear portion 254 of the baffle crease 220 and the corresponding non-linear portion of the baffle crease in the external shell 202. Gas entering the chamber 214 through either the apertures 260 or from the chamber 216 will mix and may either flow directly into the apertures 264 and/or through the formed tube defined by the non-linear portion 234 of baffle crease 218 on the external shell 204 and the corresponding non-linear portion of the shell 202. Exhaust gas traveling through the formed tube defined by the non-linear portion 234 and the opposed portion of the external shell 202 will continue to flow into the end 262 o the tail pipe 208 and toward the outlet of the exhaust system. The gas entering the tail pipe 208 at the end 262 thereof will mix with the gas entering the tail pipe 208 at the perforations 264. The relative mixing of exhaust gases within the muffler 200 can be controlled by careful selection of the cross-sectional area of the apertures 260 and 264, and by the relative cross-sectional dimensions of the formed tubes defined by the non-linear portions 234 and 254 of the external shell 204 and the cross-sectional dimensions of the corresponding registered non-linear portions of the external shell 202.

The muffler 200 illustrated in FIGS. 8 and 9 enables a desirable and widely accepted gas flow pattern with only four components. This is in sharp contrast to the prior art wrapped outer shell mufflers that would have required a minimum of nine parts to achieve this same flow pattern. Although the entirely stamp formed mufflers described above could also achieve this same flow pattern with four parts, they would, in most instances, result in a heavier muffler with somewhat higher initial capital costs for stamping dies. It is also to be understood that the gas flow pattern for the muffler 200 illustrated in FIGS. 8 and 9 can be varied significantly by having the formed tubes in only one of the registered pairs of baffle creases. For example, the baffle crease 200 of the external shell 204 could include a continuously planar portion between the non-linear portions 250 and 252. The baffle crease of the external shell 202 in register with the baffle crease 220 could be of substantially identical configuration. In this embodiment the portion of the exhaust pipe 206 between the apertures 260 and the end 258 will define a tuning tube. The chamber 216 would then define a low frequency resonating chamber. All of the exhaust gas traveling through the exhaust pipe 206 would then be urged through the apertures 260 and into the chamber 214. A portion of this gas would flow directly into the tail pipe 208 through the perforations 264, while another portion of the exhaust gas would flow through the tube formed in part by the non-linear portion 234 of the baffle crease 218 and into the chamber 212. This gas would continue to flow from the chamber 212 and into the end 262 of the tail pipe 208. The relative proportions of the exhaust gas taking these alternate flow paths to the tail pipe 208 could be controlled by the selected cross-sectional area of the non-linear portion 234 and the perforations 264 respectively.

In summary, a muffler is provided with a pair of external shells and a pair of pipes. The external shells each comprise a peripheral flange and a plurality of chambers extending from the peripheral flange. The chambers are separated from one another by baffle creases with the baffle creases of the respective external shells being generally in register with one another and having juxtaposed portions which will be in generally face-to-face contact with one another. The pipes within the muffler comprise perforations, louvers, apertures or the like to permit a controlled expansion of exhaust gases therefrom. The apertures or other such means are disposed at selected locations relative to the chambers formed in the muffler. The pipes within the muffler may extend continuously beyond the muffler to define integral or unitary portions of the exhaust pipe and tail pipe of an exhaust system. The external shells are assembled, and the pipes may be axially inserted into the assembled external shells. The baffle creases provide an efficient separation of the chambers and are unitary with remaining portions of the external shell, and further contribute to efficient welding processes and backfire resistance.

While the invention has been described with respect to preferred embodiments, it is apparent that various changes can be made without departing from the scope of the invention as defined by the appended claims.

I claim:

1. A light weight exhaust muffler comprising:

a pair of generally tubular pipes having perforation means extending therethrough for enabling the flow of exhaust gases therefrom, said pipes defining an inlet and an outlet respectively for the muffler; and a pair of formed external shells, each said external shell comprising a peripheral portion, with the peripheral portions of said external shells being securely connected to one another, each said external shell further comprising a plurality of chambers formed therein and extending from the peripheral portions thereof, the chambers of each said external shell being separated from one another by baffle creases unitary with the respective external shells and extending between and connecting spaced apart locations on the peripheral portions of said external shells, the baffle creases of said external shells being generally in register with one another and including portions surrounding and engaging the pipes of said muffler, and a non-linear portion formed in at least one of the registered baffle creases and spaced from the baffle crease in register therewith to define a formed tube extending between the chambers of the muffler separated by the baffle crease.

2. A muffler as in claim 1 wherein portions of the registered baffle creases are secured in face-to-face contact with one another.

3. A muffler as in claim 1 wherein each said external shell comprises three chambers formed therein and two baffle creases, with adjacent chambers in each said external shell being separated from one another by said baffle creases, said non-linear portion being disposed in at least one of said baffle creases to provide communication between at least two of the chambers.

4. A muffler as in claim 1 wherein the external shells are securely welded in face-to-face relationship to one another at a plurality of locations along the respective baffle creases thereof.

5. A muffler as in claim 1 wherein each said pipe is of unitary construction.

6. A muffler as in claim 5 wherein at least one of said pipes extends unitarily to locations external of said muffler.

7. A muffler as in claim 6 wherein portions of said pipe disposed externally of said muffler are of non-linear configuration.

8. A muffler as in claim 6 wherein portions of said pipes within said muffler are of linear configuration.

9. A light weight exhaust muffler, comprising:

a pair of pipes of unitary construction having opposed ends, each said pipe comprising aperture means extending therethrough at locations spaced from said ends for permitting a flow of exhaust gas therethrough, said pipes defining an inlet and an outlet respectively for the muffler; and a pair of opposed external shells securely connected to one another, each said external shell being unitarily formed to define a peripheral flange and a plurality of chambers extending from the peripheral flange thereof, the chambers being separated from one another by baffle creases formed unitarily in the respective external shells and extending between and connecting spaced apart locations on said peripheral flanges, the respective baffle creases of the opposed external shells being generally in register with one another, each said baffle crease including planar portions in abutting face-to-face relationship with the planar portions of the baffle crease in register therewith, said baffle creases further comprising nonplanar portions extending from the planar portions, selected nonplanar portions being engaging and supporting the pipes of said muffler, at least one nonplanar portion being spaced from the pipes to define a formed tube for providing communication between two of said chambers.

10. A muffler as in claim 9 wherein each said external shell is formed to define three chambers and two baffle creases.

11. A muffler as in claim 10 wherein each said baffle creases includes one of said non-linear portions disposed in spaced relationship from said pipes.

* * * * *